US005778290A

United States Patent [19]

Badesha et al.

[11] Patent Number: 5,778,290

[45] Date of Patent: Jul. 7, 1998

[54] COMPOSITE COATED DEVELOPMENT ELECTRODES AND METHODS THEREOF

[75] Inventors: Santokh S. Badesha; Arnold W. Henry, both of Pittsford; George J. Heeks, Rochester, all of N.Y.

[73] Assignee: Xerox Corporation, Stamford, Conn.

[21] Appl. No.: 841,034

[22] Filed: Apr. 29, 1997

[51] Int. Cl.[6] ..... G03G 15/08

[52] U.S. Cl. ..... 399/266

[58] Field of Search ..... 399/266

[56] References Cited

U.S. PATENT DOCUMENTS

| | | | |
|---|---|---|---|
| 4,868,600 | 9/1989 | Hays et al. | 355/259 |
| 4,984,019 | 1/1991 | Folkins | 355/215 |
| 5,010,368 | 4/1991 | O'Brien | 399/266 |
| 5,124,749 | 6/1992 | Bares | 355/202 |
| 5,172,170 | 12/1992 | Hays et al. | 355/259 |
| 5,270,782 | 12/1993 | Floyd, Jr. | 399/266 |
| 5,300,339 | 4/1994 | Hays et al. | 428/36.9 |
| 5,311,258 | 5/1994 | Brewington et al. | 399/266 |
| 5,448,342 | 9/1995 | Hays et al. | 355/259 |

*Primary Examiner*—Joan H. Pendegrass
*Assistant Examiner*—Quana Grainger
*Attorney, Agent, or Firm*—Annette L. Bade

[57] ABSTRACT

An apparatus and process for reducing accumulation of toner from the surface of an electrode member in a development unit of an electrostatographic printing apparatus by providing a composite coating on at least a portion of the electrode member.

21 Claims, 3 Drawing Sheets

COMPOSITE COATED DEVELOPMENT ELECTRODES AND METHODS THEREOF

CROSS REFERENCE TO RELATED APPLICATIONS

Attention is directed to the following copending applications assigned to the assignee of the present application: Attorney Docket No. D/96244, U.S. application Ser. No. 08/84,1033 filed Apr. 27, 1997, entitled, "Coated Development Electrodes and Methods Thereof;" Attorney Docket No. D/96244Q1, U.S. application Ser. No. 08/841136 filed Apr. 29, 1997, entitled, "Organic Coated Development Electrodes and Methods Thereof;" Attorney Docket No. D/96244Q2, U.S. application Ser. No. 08/841,234 filed Apr. 29, 1997, entitled, "Inorganic Coated Development Electrodes and Methods Thereof;" and Attorney Docket No. D/96244Q4, U.S. application Ser. No. 08/841,235 filed Apr. 29, 1997 entiled "Coating Compositions for Development Electrodes and Methods Thereof." The disclosures of each of these applications are hereby incorporated by reference in their entirety.

BACKGROUND OF THE INVENTION

The present invention relates to methods, processes and apparatii for development of images, and more specifically, to electrode members for use in a developer unit in electrophotographic printing machines. Specifically, the present invention relates to methods and apparatii in which at least a portion of a development unit electrode member is coated with a coating material, and in embodiments, a composite coating material. In embodiments, electrode member history, damping and/or toner accumulation is controlled or reduced.

Generally, the process of electrophotographic printing includes charging a photoconductive member to a substantially uniform potential so as to sensitize the photoconductive member thereof. The charged portion of the photoconductive member is exposed to a light image of an original document being reproduced. This records an electrostatic latent image on the photoconductive member. After the electrostatic latent image is recorded on the photoconductive member, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to the development zone. At least one, and preferably a plurality of electrode members are closely spaced to the donor roll in the development zone. An AC voltage is applied to the electrode members forming a toner cloud in the development zone. The electrostatic fields generated by the latent image attract toner from the toner cloud to develop the latent image.

Another type of a two component development system is a hybrid scavengeless development system which employs a magnetic brush developer roller for transporting carrier having toner adhering triboelectrically thereto. A donor roll is used in this configuration also to transport charged toner to the development zone. The donor roll and magnetic roller are electrically biased relative to one another. Toner is attracted to the donor roll from the magnetic roll. The electrically biased electrode members detach the toner from the donor roll forming a toner powder cloud in the development zone, and the latent image attracts the toner particles thereto. In this way, the latent image recorded on the photoconductive member is developed with toner particles.

Various types of development systems have hereinbefore been used as illustrated by the following disclosures, which may be relevant to certain aspects of the present invention.

U.S. Pat. No. 4,868,600 to Hays et al., the subject matter of which is hereby incorporated by reference in its entirety, describes an apparatus wherein a donor roll transports toner to a region opposed from a surface on which a latent image is recorded. A pair of electrode members are positioned in the space between the latent image surface and the donor roll and are electrically biased to detach toner from the donor roll to form a toner cloud. Detached toner from the cloud develops the latent image.

U.S. Pat. No. 4,984,019, to Folkins, the subject matter of which is hereby incorporated by reference in its entirety, discloses a developer unit having a donor roll with electrode members disposed adjacent thereto in a development zone. A magnetic roller transports developer material to the donor roll. Toner particles are attracted from the magnetic roller to the donor roller. When the developer unit is inactivated, the electrode members are vibrated to remove contaminants therefrom.

U.S. Pat. 5,124,749 to Bares, the subject matter of which is hereby incorporated by reference in its entirety, discloses an apparatus in which a donor roll advances toner to an electrostatic latent image recorded on a photoconductive member wherein a plurality of electrode wires are positioned in the space between the donor roll and the photoconductive member. The wires are electrically biased to detach the toner from the donor roll so as to form a toner cloud in the space between the electrode wires and the photoconductive member. The powder cloud develops the latent image. A damping material is coated on a portion of the electrode wires at the position of attachment to the electrode supporting members for the purpose of damping vibration of the electrode wires.

U.S. Pat. 5,300,339 and 5,448,342 both to Hays et al., the subject matter each of which is hereby incorporated by reference in their entirety, disclose a coated toner transport roll containing a core with a coating thereover.

U.S. Pat. 5,172,170 to Hays et al., the subject matter of which is hereby incorporated by reference in its entirety, discloses an apparatus in which a donor roll advances toner to an electrostatic latent image recorded on a photoconductive member. The donor roll includes a dielectric layer disposed about the circumferential surface of the roll between adjacent grooves.

Primarily because the adhesion force of the toner particles is greater than the stripping force generated by the electric field of the electrode members in the development zone, a problem results in that toner tends to build up on the electrode members. Accumulation of toner particles on the wire member causes non-uniform development of the latent image, resulting in print defects. The problem is aggravated by toner fines and any toner components, such as high molecular weight, crosslinked and/or branched components, and the voltage breakdown between the wire member and the donor roll.

One specific example of toner contamination results upon development of a document having solid areas which require a large concentration of toner to be deposited at a particular position on the latent image. The areas of the electrode member corresponding to the high throughput or high toner concentration areas tend to include higher or lower accumulation of toner because of this differing exposure to toner throughput. When the printer subsequently attempts to develop another, different image, the toner accumulation on the electrode member will lead to differential development of the newly developed image corresponding to the areas of greater or lesser toner accumulation on the electrode members. The result is a darkened or lightened band in the position corresponding to the solid area of the previous image. This is particularly evident in areas of intermediate density, since these are the areas most sensitive to differences in development. These particular image defects caused by toner accumulation on the electrode wires at the development zone are referred to as wire history. FIG. 5 contains an illustration of wire contamination and wire history. Wire contamination results when fused toner forms between the electrode member and donor member due to toner fines and any toner components, such as high molecular weight, crosslinked and/or branched components, and the voltage breakdown between the wire member and the donor roll. Wire history is a change in developability due to toner or toner components sticking to the top of the electrode member.

Accordingly, there is a specific need for electrode members in the development zone of a development unit of an electrophotographic printing machine which provide for a decreased tendency for toner accumulation in order to decrease wire history and wire contamination, especially at high throughput areas, and decreasing the production of unwanted surface static charges from which contaminants may not release. One possible solution is to change the electrical properties of the wire. However, attempts at decreasing toner build-up on the development wire by changing the electrical properties thereof, may result in an interference with the function of the wire and its ability to produce the formation of the toner powder cloud. Therefore, there is a specific need for electrode members which have a decreased tendency to accumulate toner and which also retain their electrical properties in order to prevent interference with the functioning thereof. There is an additional need for electrode members which have superior mechanical properties including durability against severe wear the electrode member receives when it is repeatedly brought into contact with tough rotating donor roll surfaces.

SUMMARY OF THE INVENTION

Examples of objects of the present invention include:

It is an object of the present invention to provide an apparatus for reducing toner accumulation of electrode members in the development zone of a developing unit in an electrophotographic printing apparatus with many of the advantages indicated herein.

Another object of the present invention is to provide an apparatus for reducing toner adhesion to electrode members.

It is another object of the present invention to provide an apparatus comprising electrode members having a lower surface energy.

It is yet another object of the present invention to provide an apparatus comprising electrode members having increased mechanical strength.

Still yet another object of the present invention is to provide an apparatus comprising electrode members which have superior electrical properties.

A further object of the present invention is to provide an apparatus comprising electrode members which have smooth surfaces.

Many of the above objects have been met by the present invention, in embodiments, which includes: an apparatus for developing a latent image recorded on a surface, comprising: wire supports; a donor member spaced from the surface and being adapted to transport toner to a region opposed from the surface; an electrode member positioned in the space between the surface and the donor member, the electrode member being closely spaced from the donor member and is being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a composite coating on at least a portion of nonattached regions of said electrode member.

Embodiments further include: an electrophotographic process comprising: a) forming an electrostatic latent image on a charge-retentive surface; b) applying toner in the form of a toner cloud to said latent image to form a developed image on said charge retentive surface, wherein said toner is applied using a development apparatus comprising wire supports; a donor member spaced from the surface and being adapted to transport toner to a region opposed from the surface; an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image, wherein opposed end regions of said electrode member are attached to said wire supports adapted to support the opposed end regions of said electrode member; and a composite coating on at least a portion of nonattached regions of said electrode member; c) transferring the toner image from said charge-retentive surface to a substrate; and d) fixing said toner image to said substrate.

The present invention provides electrode members which, in embodiments, have a decreased tendency to accumulate toner and which also, in embodiments, retain their electrical properties in order to prevent interference with the functioning thereof. The present invention further provides electrode members which, in embodiments, have superior mechanical properties including durability against severe wear the electrode member receives when it is repeatedly brought into contact with tough rotating donor roll surfaces.

BRIEF DESCRIPTION OF THE DRAWINGS

The above aspects of the present invention will become apparent as the following description proceeds upon reference to the drawings in which.

DETAILED DESCRIPTION

For a general understanding of the features of the present invention, a description thereof will be made with reference to the drawings.

Figure 1:
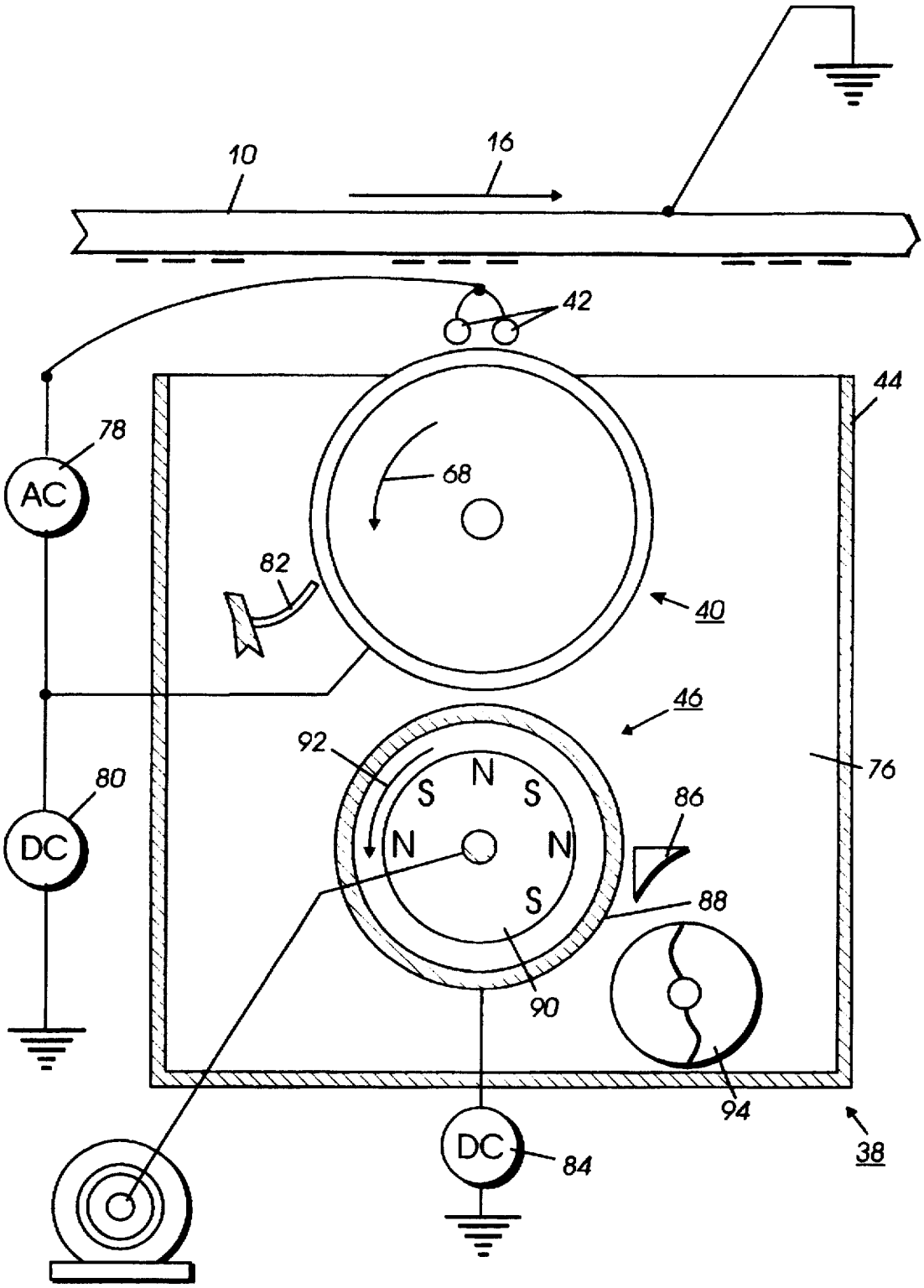
FIG. 1 is a schematic illustration of an embodiment of a development apparatus useful in an electrophotographic printing machine.

FIG. 1 shows a development apparatus used in an electrophotographic printing machine such as that illustrated and described in U.S. Pat. 5,124,749, the disclosure of which is hereby incorporated by reference in its entirety. This patent describes the details of the main components of an electrophotographic printing machine and how these components interact. The present application will concentrate on the development unit of the electrophotographic printing machine. Specifically, after an electrostatic latent image has been recorded on a photoconductive surface, a photoreceptor belt advances the latent image to the development station. At the development station, a developer unit develops the latent image recorded on the photoconductive surface.

Referring now to FIG. 1, in a preferred embodiment of the invention, developer unit 38 develops the latent image recorded on the photoconductive surface 10. Preferably, developer unit 38 includes donor roller 40 and electrode member or members 42. Electrode members 42 are electrically biased relative to donor roll 40 to detach toner therefrom so as to form a toner powder cloud in the gap between the donor roll 40 and photoconductive surface 10. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller 46 disposed interior of the chamber of housing 44 conveys the developer material to the donor roller 40. The magnetic roller 46 is electrically biased relative to the donor roller so that the toner particles are attracted from the magnetic roller to the donor roller.

More specifically, developer unit 38 includes a housing 44 defining a chamber 76 for storing a supply of two component (toner and carrier) developer material therein. Donor roller 40, electrode members 42 and magnetic roller 46 are mounted in chamber 76 of housing 44. The donor roller can be rotated in either the 'with' or 'against' direction relative to the direction of motion of belt 10. In FIG. 1, donor roller 40 is shown rotating in the direction of arrow 68. Similarly, the magnetic roller can be rotated in either the 'with' or 'against' direction relative to the direction of motion of belt 10. In FIG. 1, magnetic roller 46 is shown rotating in the direction of arrow 92. Donor roller 40 is preferably made from anodized aluminum or ceramic.

Developer unit 38 also has electrode members 42 which are disposed in the space between the belt 10 and donor roller 40. A pair of electrode members are shown extending in a direction substantially parallel to the longitudinal axis of the donor roller. The electrode members are made from of one or more thin (i.e., 50 to 100 μm in diameter) stainless steel or tungsten electrode members which are closely spaced from donor roller 40. The distance between the electrode members and the donor roller is from about 0.001 to about 45 μm, preferably about 10 to about 25 μm or the thickness of the toner layer on the donor roll. The electrode members are self-spaced from the donor roller by the thickness of the toner on the donor roller. To this end, the extremities of the electrode members supported by the tops of end bearing blocks also support the donor roller for rotation. The electrode member extremities are attached so that they are slightly above a tangent to the surface, including toner layer, of the donor structure. Mounting the electrode members in such a manner makes them insensitive to roll run-out due to their selfspacing.

As illustrated in FIG. 1, an alternating electrical bias is applied to the electrode members by an AC voltage source 78. The applied AC establishes an alternating electrostatic field between the electrode members and the donor roller is effective in detaching toner from the photoconductive member of the donor roller and forming a toner cloud about the electrode members, the height of the cloud being such as not to be substantially in contact with the belt 10. The magnitude of the AC voltage is relatively low and is in the order of 200 to 500 volts peak at a frequency ranging from about 9 kHz to about 15 kHz. A DC bias supply 80 which applies approximately 300 volts to donor roller 40 establishes an electrostatic field between photoconductive member of belt 10 and donor roller 40 for attracting the detached toner particles from the cloud surrounding the electrode members to the latent image recorded on the photoconductive member. At a spacing ranging from about 0.001 μm to about 45 μm between the electrode members and donor roller, an applied voltage of 200 to 500 volts produces a relatively large electrostatic field without risk of air breakdown. A cleaning blade 82 strips all of the toner from donor roller 40 after development so that magnetic roller 46 meters fresh toner to a clean donor roller. Magnetic roller 46 meters a constant quantity of toner having a substantially constant charge onto donor roller 40. This insures that the donor roller provides a constant amount of toner having a substantially constant charge in the development gap. In lieu of using a cleaning blade, the combination of donor roller spacing, i.e., spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially charge on the donor roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 1, an auger, indicated generally by the reference numeral 94, is located in chamber 76 of housing 44. Auger 94 is mounted rotatably in chamber 76 to mix and transport developer material. The auger has blades extending spirally outwardly from a shaft. The blades are designed to advance the developer material in the axial direction substantially parallel to the longitudinal axis of the shaft.

As successive electrostatic latent images are developed, the toner particles within the developer are depleted. A toner dispenser (not shown) stores a supply of toner particles which may include toner and carrier particles. The toner dispenser is in communication with chamber 76 of housing 44. As the concentration of toner particles in the developer is decreased, fresh toner particles are furnished to the developer in the chamber from the toner dispenser. In an embodiment of the invention, the auger in the chamber of the housing mix the fresh toner particles with the remaining developer so that the resultant developer therein is substantially uniform with the concentration of toner particles being optimized. In this way, a substantially constant amount of toner particles are in the chamber of the developer housing with the toner particles having a constant charge. The developer in the chamber of the developer housing is magnetic and may be electrically conductive. By way of example, in an embodiment of the invention wherein the toner includes carrier particles, the carrier granules include a ferromagnetic core having a thin layer of magnetite overcoated with a non-continuous layer of resinous material. The toner particles may be made from a resinous material, such as a vinyl polymer, mixed with a coloring material, such as chromogen black. The developer may comprise from about 90% to about 99% by weight of carrier and from 10% to about 1% by weight of toner. However, one skilled in the art will recognize that any other suitable developer may be used.

In an alternative embodiment of the present invention, one component developer consisting of toner without carrier may be used. In this configuration, the magnetic roller 46 is not present in the developer housing . This embodiment is described in more detail in U.S. Pat. 4,868,600, the disclosure of which is hereby incorporated by reference in its entirety.

Figure 2:
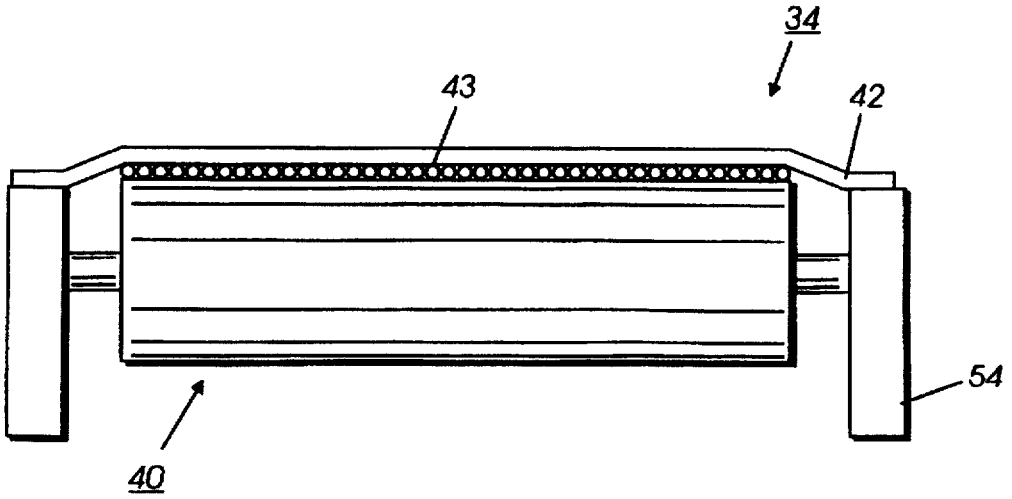
FIG. 2 is an enlarged, schematic illustration of a donor roll and electrode member representing an embodiment of the present invention.

An embodiment of the developer unit is further depicted in FIG. 2. The developer apparatus 34 comprises an electrode member 42 which is disposed in the space between the photoreceptor (not shown in FIG. 2) and the donor roll 40. The electrode 42 can be comprised of one or more thin (i.e., 50 to about 100 μm in diameter) tungsten or stainless steel electrode members which are lightly positioned at or near the donor structure 40. The electrode member is closely spaced from the donor member. The distance between the wire(s) and the donor is approximately 0.001 to about 45 μm, and preferably from about 10 to about 25 μm or the thickness of the toner layer 43 on the donor roll. The wires as shown in FIG. 2 are self spaced from the donor structure by the thickness of the toner on the donor structure. The extremities or opposed end regions of the electrode member are supported by support members 54 which may also support the donor structure for rotation. In a preferred embodiment, the electrode member extremities or opposed end regions are attached so that they are slightly below a tangent to the surface, including toner layer, of the donor structure. Mounting the electrode members in such a manner makes them insensitive to roll runout due to their self-spacing.

Figure 3:
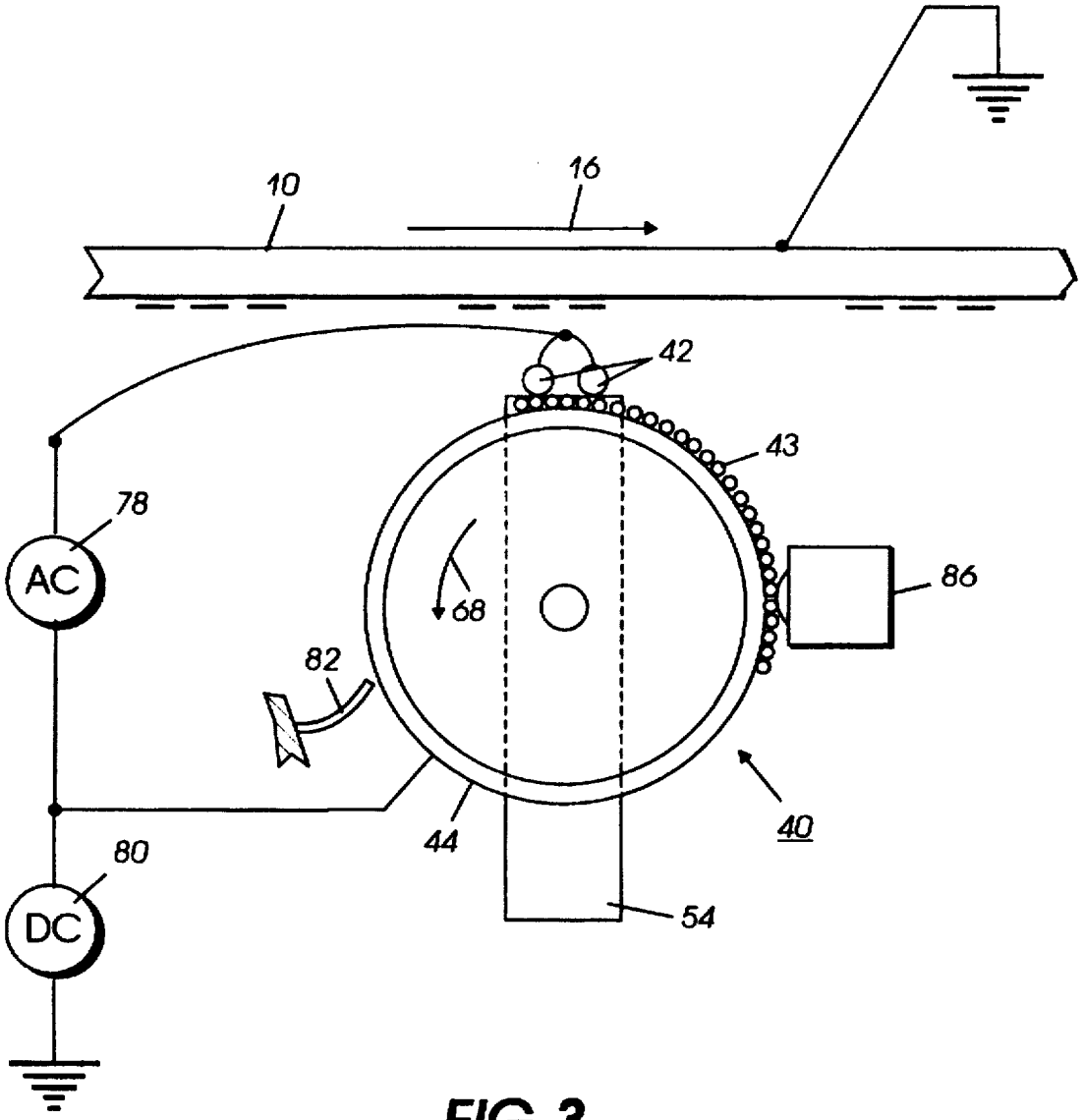
FIG. 3 is a fragmentary schematic illustration of a development housing comprising a donor roll and an electrode member from a different angle than as shown in FIG. 2.

In an alternative embodiment to that depicted in FIG. 1, the metering blade 86 is replaced by a combined metering and charging blade 86 as shown in FIG. 3. The combination metering and charging device may comprise any suitable device for depositing a monolayer of well charged toner onto the donor structure 40. For example, it may comprise an apparatus such as that described in U.S. Pat. No. 4,459,009, wherein the contact between weakly charged toner particles and a triboelectrically active coating contained on a charging roller results in well charged toner. Other combination metering and charging devices may be employed, for example, a conventional magnetic brush used with two component developer could also be used for depositing the toner layer onto the donor structure, or a donor roller alone used with one component developer.

Figure 4:
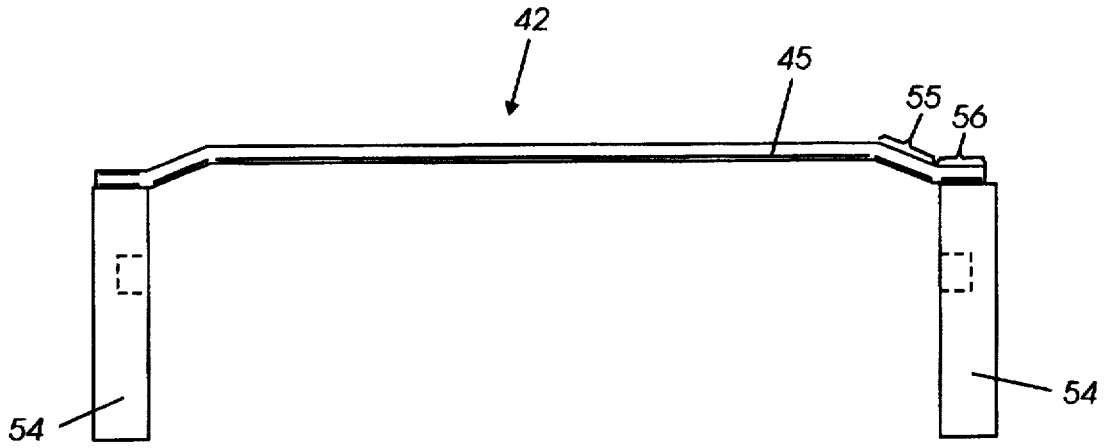
FIG. 4 is an enlarged, schematic illustration of an electrode member supported by mounting means in an embodiment of the present invention.

FIG. 4 depicts an enlarged view of a preferred embodiment of the electrode member of the present invention. Electrode wires 45 are positioned inside electrode member 42. The anchoring portions 55 of the electrode members are the portions of the electrode member which anchor the electrode member to the support member. The mounting sections 56 of the electrode member are the sections of the electrode members between the electrode member and the mounting means 54.

Toner particles are attracted to the electrode members primarily through electrostatic attraction. Toner particles adhere to the electrode members because the adhesion force of the toner is larger than the stripping force generated by the electric field of the electrode member. Generally, the adhesion force between a toner particle and an electrode member is represented by the general expression $F_{ad}=q^2/kr^2+W$, wherein $F_{ad}$ is the force of adhesion, q is the charge on the toner particle, k is the effective dielectric constant of the toner and any dielectric coating, and r is the separation of the particle from its image charge within the wire which depends on the thickness, dielectric constant, and conductivity of the coating. Element W is the force of adhesion due to short range adhesion forces such as van der Waals and capillary forces. The force necessary to strip or remove particles from the electrode member is supplied by the electric field of the wire during half of its AC period, qE, plus effective forces resulting from mechanical motion of the electrode member and from bombardment of the wire by toner in the cloud. Since the adhesion force is quadratic in q, adhesion forces will be larger than stripping forces.

Figure 5:
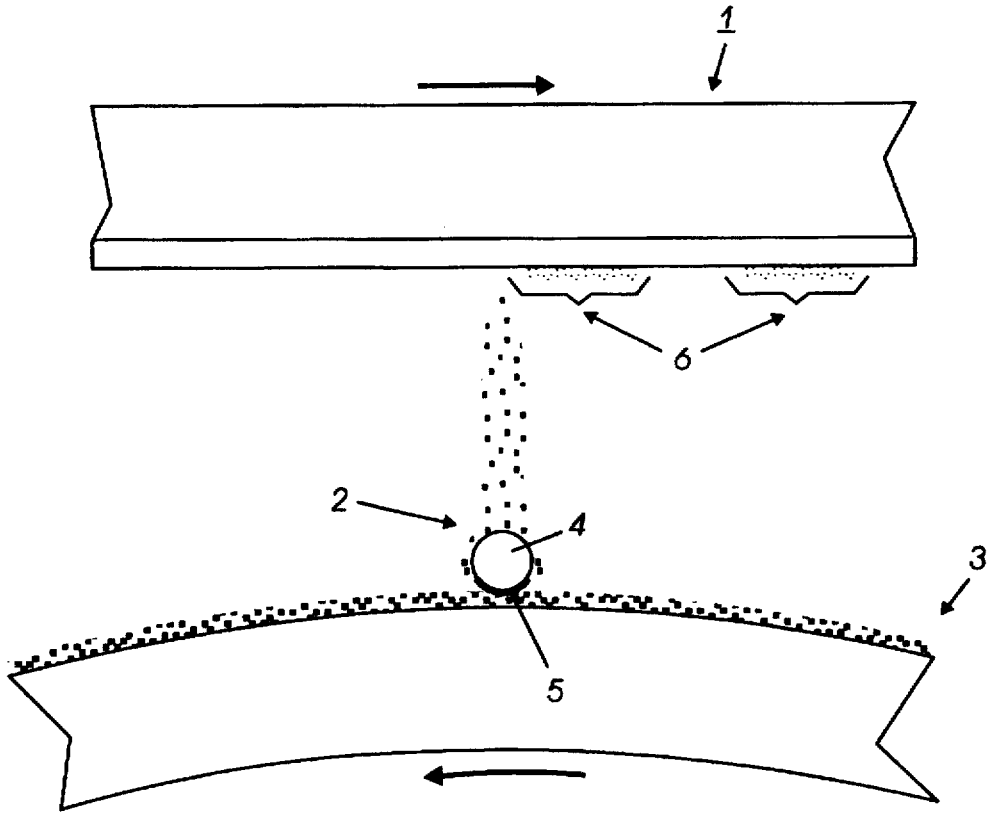
FIG. 5 (Prior Art)
FIG. 5 is an illustration of wire contamination and wire history.

FIG. 5 contains an illustration of wire contamination and wire history. A photoreceptor 1 is positioned near wire 4 and contains an undeveloped image 6 which is subsequently developed by toner originating from donor member 3. Wire contamination occurs when fused toner 5 forms between the wire 4 and donor member 3. The problem is aggravated by toner fines and any toner components, such as high molecular weight, crosslinked and/or branched components, and the voltage breakdown between the wire member and the donor roll. Wire history is a change in developability due to toner 2 or toner components sticking to the top of the wire 4, the top of the wire being the part of the wire facing the photoreceptor.

In order to prevent the toner defects associated with wire contamination and wire history, the electrical properties of the electrode member can be changed, thereby changing the adhesion forces in relation to the stripping forces. However, such changes in the electrical properties of the electrode member may adversely affect the ability of the electrode member to adequately provide a toner cloud, which is essential for developing a latent image. The present invention is directed to an apparatus for reducing the unacceptable accumulation of toner on the electrode member while maintaining the desired electrical and mechanical properties of the electrode member. The electrode member of the present invention is coated with a material coating that reduces the significant attraction of toner particles to the electrode member which may result in toner accumulation. However, the material coating does not adversely interfere with the mechanical or electrical properties of the electrode member. Materials having these qualities include composite materials as described herein.

The composite material decreases the accumulation of toner by assuring electrical continuity for charging the wires and eliminates the possibility of charge build-up. In addition, such low surface energy materials as described herein do not interfere with the electrical properties of the electrode member and do not adversely affect the electrode's ability to produce a toner powder cloud. Moreover, the electrode member maintains its tough mechanical properties, allowing the electrode member to remain durable against the severe wear the electrode member receives when it is repeatedly brought into contact with tough, rotating donor roll surfaces. Also, the electrode member maintains a "smooth" surface after the coating is applied. A smooth surface includes surfaces having a surface roughness of less than about 5 microns, preferably from about 0.01 to about 1 micron.

Examples of suitable electrode coating materials include polymer composites which are hybrid polymers comprising at least two distinguishing polymer systems, blocks or monomer segments, one monomer segment (hereinafter referred to as a "first monomer segment") of which possesses a high wear resistance and high toughness, and the other monomer segment (hereinafter referred to as a "second monomer segment") of which possesses low surface energy. The high toughness monomer segment has a toughness value of from about 2000 to 25,000 in.-lb./in.$^3$ and more preferably from about 4000 to about 25,000 in.-lb./in.$^3$. Monomer segments having this toughness range exhibit increased wear resistance. Toughness is defined as the integrated area under a stress versus the strain curve of a particular material up to its point of fracture. Measurements for toughness include tensile strength (breaking stress) and ultimate elongation (breaking strain) for polymers made from "first monomer segment" materials. To measure toughness, Applicants calculated the area under the curve by assuming it to be triangular in shape. This technique is well-known to one of skill in the relevant art. Thus the toughness area would be one-half the product of the tensile stress times the ultimate elongation.

The second monomer segment possesses a relatively low surface energy of from about 5 to about 35 dynes/cm, preferably from about 10 to about 25 dynes/cm.

The composite materials described herein are hybrid or copolymer compositions comprising substantially uniform, integral, interpenetrating networks of a first monomer segment and a second monomer segment, and in some embodiments, optionally a third grafted segment, wherein both the structure and the composition of the segment networks are substantially uniform when viewed through different slices of the wire layer. Interpenetrating network, in embodiments, refers to the addition polymerization matrix where the polymer strands of the first monomer segment and second monomer segment, and optional third grafted segment, are intertwined in one another. A copolymer composition, in embodiments, is comprised of a first monomer segment and second monomer segment, and an optional third grafted segment, wherein the monomer segments are randomly arranged into a long chain molecule.

Because the copolymers and grafted copolymers comprise a tough monomer segment and a low surface energy monomer segment, the resulting copolymer and grafted copolymers exhibit the increased toughness quality of the first monomer segment, along with exhibiting a smooth surface due to the presence of the low surface energy monomer segment. These combined qualities exhibit superior results in combination.

Examples of polymers suitable for use as the first monomer segment or tough monomer segment include such as, for example polyamides, polyimides, polysulfones, polystyrenes, polypropylene, polyesters, and the like. Another suitable first monomer segment or tough monomer segment polymer includes the fluoroelastomers such as, for example those described in detail in U.S. Pat. Nos. 5,166,031, 5,281,506, 5,366,772 and 5,370,931, together with U.S. Pat. Nos. 4,257,699, 5,017,432 and 5,061,965, the disclosures of which are incorporated by reference herein in their entirety. As described therein, these fluoroelastomers, particularly from the class of copolymers and terpolymers of vinylidenefluoride hexafluoropropylene and tetrafluoroethylene, are known commercially under various designations as VITON A®, VITON E®, VITON E60C®, VITON E430®, VITON 910®, VITON GH® and VITON GF®. The VITON® designation is a Trademark of E.I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS ™ a poly(propylene-tetrafluoroethylene) and FLUOREL II® (LII900) a poly(propylene-tetrafluoroethylenevinylidenefluoride) both also available from 3M Company, as well as the Tecnoflons identified as FOR60KIR®, FOR-LHF®, NM® FOR-THF®, FOR-TFS®, TH®, TN505® available from Montedison Specialty Chemical Company. Other elastomers useful in the present invention include silicone rubbers, ethylene-propylene-diene monomer (hereinafter "EPDM"), epichlorohydrin, styrene-butadiene, fluorosilicone, polyurethane elastomers, and the like. Two preferred known fluoroelastomers are (1) a class of copolymers of vinylidenefluoride and hexafluoropropylene known commercially as VITON A® and (2) a class of terpolymers of vinylidenefluoride, hexafluoropropylene and tetrafluoroethylene known commercially as VITON B®. VITON A®, and VITON B®, and other VITON® designations are trademarks of E.I. DuPont de Nemours and Company. Other commercially available materials include FLUOREL TM of 3M Company, VITON GH®, VITON E60C®, VITON B 910®, and VITON E 430®. In another preferred embodiment, the fluoroelastomer is one having a relatively low quantity of vinylidenefluoride, such as in VITON GF®, available from E.I. DuPont de Nemours, Inc. The VITON GF® has 35 weight percent of vinylidenefluoride, 34 weight percent of hexafluoropropylene and 29 weight percent of tetrafluoroethylene with 2 percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer.

Examples of the low surface energy monomer segments or second monomer segment polymers include polyorganosiloxanes. In embodiments, the polyorganosiloxane has the formula I:

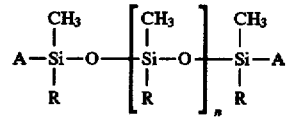

where R is an alkyl from about 1 to about 24 carbons, or an alkenyl of from about 2 to about 24 carbons, or a substituted or unsubstituted aryl of from about 4 to about 24 carbons; A is an aryl of from about 6 to about 24 carbons, a substituted or unsubstituted alkene of from about 2 to about 8 carbons, or a substituted or unsubstituted alkyne of from about 2 to about 8 carbons; and n is from about 2 to about 400, and preferably from about 10 to about 200 in embodiments.

In preferred embodiments, R is an alkyl, alkenyl or aryl, wherein the alkyl has from about 1 to about 24 carbons, preferably from about 1 to about 12 carbons; the alkenyl has from about 2 to about 24 carbons, preferably from about 2 to about 12 carbons; and the aryl has from about 4 to about 24 carbon atoms, preferably from about 6 to about 18 carbons. R may be a substituted aryl group, wherein the aryl may be substituted with an amino, hydroxy, mercapto or substituted with an alkyl having for example from about 1 to about 24 carbons and preferably from 1 to about 12 carbons, or substituted with an alkenyl having for example from about 2 to about 24 carbons and preferably from about 2 to about 12 carbons. In a preferred embodiment, R is independently selected from methyl, ethyl, and phenyl. The functional group A can be an alkene or alkyne group having from about 2 to about 8 carbon atoms, preferably from about 2 to about 4 carbons, optionally substituted with an alkyl having for example from about 1 to about 12 carbons, and preferably from about 1 to about 12 carbons, or an aryl group having for example from about 6 to about 24 carbons, and preferably from about 6 to about 18 carbons. Functional group A can also be mono-, di-, or trialkoxysilane having from about 1 to about 10 and preferably from about 1 to about 6 carbons in each alkoxy group, hydroxy, or halogen. Preferred alkoxy groups include methoxy, ethoxy, and the like. Preferred halogens include chlorine, bromine and fluorine. A may also be an alkyne of from about 2 to about 8 carbons, optionally substituted with an alkyl of from about 1 to about 24 carbons or aryl of from about 6 to about 24 carbons. The group n is from about 2 to about 400, and in embodiments from about 2 to about 350, and preferably from about 5 to about 100. Furthermore, in a preferred embodiment n is from about 60 to about 80 to provide a sufficient number of reactive groups to graft onto the fluoroelastomer. In the above formula, typical R groups include methyl, ethyl, propyl, octyl, vinyl, allylic crotnyl, phenyl, naphthyl and phenanthryl, and typical substituted aryl groups are substituted in the ortho, meta and para positions with lower alkyl groups having from about 1 to about 15 carbon atoms. Typical alkene and alkenyl functional groups include vinyl, acrylic, crotonic and acetenyl which may typically be substituted with methyl, propyl, butyl, benzyl, tolyl groups, and the like.

Other examples of suitable second monomer segments include intermediates which form inorganic networks. An intermediate is a precursor to inorganic oxide networks present in polymers described herein. This precursor goes through hydrolysis and condensation followed by the addition reactions to form desired network configurations of, for example, networks of metal oxides such as titanium oxide, silicon oxide, zirconium oxide and the like; networks of metal halides; and networks of metal hydroxides. Examples of intermediates include metal alkoxides, metal halides, metal hydroxides, and a polyorganosiloxane as defined above. The preferred intermediates are alkoxides, and specifically preferred are tetraethoxy orthosilicate for silicon oxide network and titanium isobutoxide for titanium oxide network.

In embodiments, a third low surface energy monomer segment is a grafted monomer segment and, in preferred embodiments, is a polyorganosiloxane as described above. In these preferred embodiments, it is particularly preferred that the second monomer segment is an intermediate to a network of metal oxide. Preferred intermediates include tetraethoxy orthosilicate for silicon oxide network and titanium isobutoxide for titanium oxide network.

Examples of suitable polymer composites include volume grafted elastomers, titamers, grafted titamers, ceramers, grafted ceramers, polyamide polyorganosiloxane copolymers, polyimide polyorganosiloxane copolymers, polyester polyorganosiloxane copolymers, polysulfone polyorganosiloxane copolymers, polystyrene polyorganosiloxane copolymers, polypropylene poloyorganosiloxane copolymers, and polyester polyorganosiloxane copolymers.

Volume grafted elastomers are a special form of hydrofluoroelastomer in which polyorganosiloxane polymer molecules (second monomer segments) are grafted onto the high molecular weight, hydrofluoroelastomer copolymer chain (first monomer segment), wherein both the structure and the composition of the fluoroelastomer and polyorganosiloxane are substantially uniform when taken through different slices of the layer, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator. Examples of specific volume graft elastomers are disclosed in U.S. Pat. No. 5,166,031; U.S. Pat. No. 5,281,506; U.S. Pat. No. 5,366,772; and U.S. Pat. No. 5,370,931, the disclosures each of which are herein incorporated by reference in their entirety. Interpenetrating network, in embodiments, refers to the addition polymerization matrix where the fluoroelastomer and polyorganosiloxane polymer strands are intertwined in one another. Hybrid composition, in embodiments, refers to a volume grafted composition which is comprised of a fluoroelastomer copolymer onto which polyorganosiloxane blocks are grafted.

Ceramers are also preferred polymer composites useful as wire coatings. A ceramer generically refers to a hybrid material of organic and composite composition which typically has ceramic-like properties. As used herein, the term ceramer refers to, in embodiments, a composite polymer comprised of substantially uniform integral interpenetrating networks of a haloelastomer (first monomer segment) and silicon oxide (second monomer segment is tetraethoxy orthosilicate). The term grafted ceramer refers to, in embodiments, a composite polymer comprised of substantially uniform integral interpenetrating networks of a polyorganosiloxane grafted haloelastomer and silicon oxide network. In the grafted ceramer, the haloelastomer is the first monomer segment, the polyorganosiloxane is the third monomer segment and the second monomer segment is tetraethoxy orthosilicate, the intermediate to a silicon oxide network. Both the structure and the composition of the polyorganosiloxane grafted haloelastomer and silicon oxide networks are substantially uniform when viewed through different slices of the layer. The phrase interpenetrating network refers to the intertwining of the haloelastomer and silicon oxide network polymer strands for the ceramer, and to the intertwining of the polyorganosiloxane grafted haloelastomer and silicon oxide polymer network strands for the grafted ceramer. The phrase haloelastomer may be any suitable halogen containing elastomer such as a chloroelastomer, a bromoelastomer, or the like, mixtures thereof, and preferably is a fluoroelastomer. Examples of suitable fluoroelastomers are set forth above. Examples of suitable polyorganosiloxanes are referred to above. The phrases "silicon oxide," "silicon oxide network," "network of silicon oxide" and the like refer to alternating, covalently bound atoms of metal and oxygen, wherein alternating atoms of silicon and oxygen may exist in a linear, branched, and/or lattice pattern. The atoms of silicon and oxygen exist in a network and not as discrete particles. Preferred ceramers and grafted ceramers are described in U.S. Pat. N0. 5,337,129, the disclosure of which is hereby incorporated by reference in its entirety.

In a preferred embodiment of the invention, the ceramer has the following formula II:

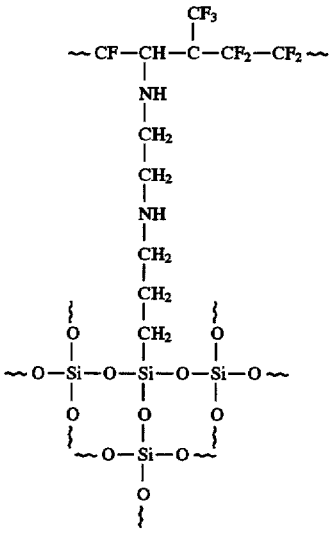

In the above formula, the symbol "~" represents a continuation of the polymer network.

In a preferred embodiment of the invention, a grafted ceramer has the following formula III:

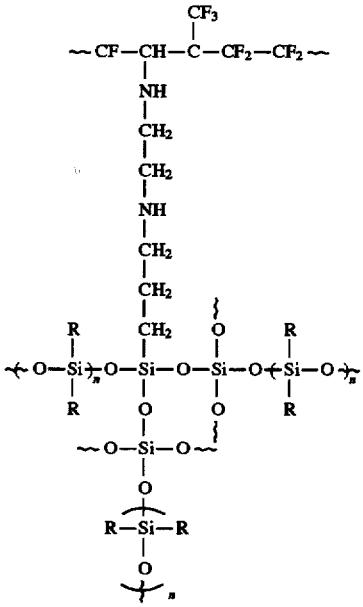

In the above formula, R is the R group of the polyorganosiloxane described above and may be a substituent as defined herein for the R group of the polyorganosiloxane; n is a number as herein defined for the n of the polyorganosiloxane above; and the symbol "~" represents a continuation of the polymer network.

Titamers are also preferred polymer composites suitable for the wire coating herein. Titamers are discussed in U.S. Pat. No. 5,500,298; 5,500,299; and 5,486,987, the disclosures each of which are hereby incorporated by reference in their entireties. As used herein, the phrase titamer refers to a composite material comprised of substantially uniform integral interpenetrating networks of haloelastomer (first monomer segment) and titanium oxide network (second monomer segment), wherein both the structure and the composition of the haloelastomer and titanium oxide network, are substantially uniform when viewed through different slices of the wire coating layer. The phrase grafted titamer refers to a substantially uniform integral interpenetrating networks of a polyorganosiloxane grafted haloelastomer and titanium oxide network, wherein the haloelastomer is the first monomer segment, the poloyorganosiloxane is the third grafted monomer segment and titanium isobutoxide, the intermediate to titanium oxide network, is the second monomer segment. Both the structure and the composition of the polyorganosiloxane grafted haloelastomer and titanium oxide network are substantially uniform when viewed through different slices of the wire coating layer. The phrase interpenetrating network refers to the intertwining of the haloelastomer and titanium oxide network polymer strands for the titamer, and to the intertwining of the polyorganosiloxane grafted haloelastomer and titanium oxide network polymer strands for the grafted titamer. The phrase haloelastomer may be any suitable halogen containing elastomer such as a chloroelastomer, a bromoelastomer, or the like, mixtures thereof, and preferably is a fluoroelastomer as described above. The phrase "titanium oxide," "network of titanium oxide," or "titanium oxide network" or similar phrases refers to alternating, covalently bound atoms of titanium and oxygen, wherein the alternating atoms of titanium and oxygen may exist in a linear, branched and/or lattice pattern. The atom of titanium and oxygen exist in a network and not as discrete particles.

Examples of titamers include those having the following formula IV:

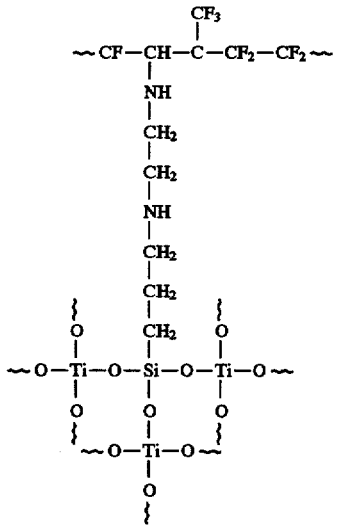

In the above formula, the symbol "~" represents the continuation of the polymeric network.

Examples of grafted titamers include those having the following formula V:

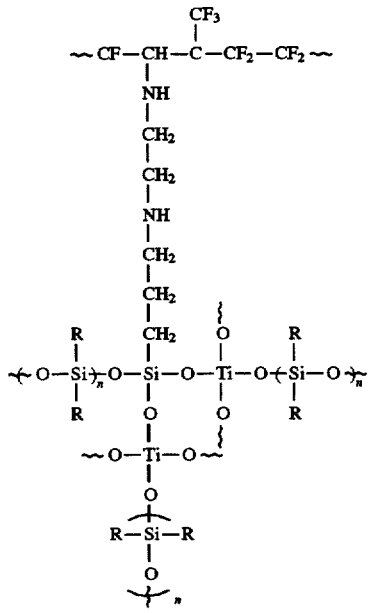

In the above formula, R is the R group of the polyorganosiloxane described above and may be a substituent as defined herein for the R group of the polyorganosiloxane; n is a number as herein defined for the n of the polyorganosiloxane above; and the symbol "~" represents a continuation of the polymer network.

Other examples of composites useful as wire coatings include polyimide polyorganosiloxane having as the first monomer segment, a polyimide, and as the second monomer segment, a polyorganosiloxane. The size of the polyorganosiloxane block may vary from about 5 to about 95 weight percent, and preferably from about 10 to about 50 weight percent by weight of total polyimide polyorganosiloxane copolymer. The polyimide is present in an amount of from about 95 to about 5 weight percent, and preferably from about 90 to about 40 weight percent by weight of total polyimide polyorganosiloxane. The details are given in U.S. Pat. No. 5,212,496, the disclosure of which is hereby incorporated by reference in its entirety.

Further examples of suitable composites include polyester polyorganosiloxane copolymers, wherein the first monomer segment of the composite is a polyester and the second monomer segment is a polyorganosiloxane. The size of the polyorganosiloxane block may vary from about 5 to about 95 weight percent, and preferably from about 10 to about 50 weight percent by total weight of polyester polyorganosiloxane copolymer. The polyester is present in an amount of from about 95 to about 5 weight percent, and preferably from about 90 to about 40 weight percent by weight of total polyester polyorganosiloxane.

When two monomer segments are present in an embodiment of the composite material of the present invention, the second monomer segment is preferably present in an amount of from about 1 to about 75 percent by weight of the composite, preferably from about 5 to about 50 percent by weight of the composite, and the first monomer segment is present in an amount of from about 99 to about 25 percent by weight of the composite, preferably from about 95 to about 50 percent by weight of the composite. In embodiments wherein there is present a third grafted segment, the first monomer segment is present in an amount of from about 99 to about 25 percent by weight of the composite, preferably from about 95 to about 50 percent by weight of the composite; the second monomer segment (e.g., intermediates to titanium oxide network or intermediates to silicon oxide network in preferred embodiments) is present in an amount of from about 0.5 to about 25 percent by weight of composite material, and preferably from about 2.5 to about 12.5 percent by weight of composite; and the third grafted segment (e.g., polyorganosiloxane in preferred embodiments) is present in an amount of from about 0.5 to about 25 percent by weight of composite, and preferably from about 2.5 to about 12.5 percent by weight of composite.

The composite coating material is preferably present in an amount of from about 5 to about 95 percent by weight of total solids, and preferably from about 10 to about 40 percent by weight of total solids. Total solids as used herein, refers to the total amount by weight of composite coating material, catalyst, solvent, optional fillers, and optional additives contained in the coating solution.

A filler such as an electrically conductive filler, may be added to the material coating in the amount of from about 5 to about 35 percent by weight of total solids, preferably from about 15 to about 20 percent by weight of total solids. Examples of electrically conductive fillers include metal oxides and metal hydroxides such as tin oxide, titanium oxide, zirconium oxide, calcium hydroxide, magnesium oxide and the like. Another preferred filler is carbon black, graphite or the like, with surface treatment of compounds such as for example, siloxane, silane, fluorine or the like. Specifically preferred treated carbon blacks include fluorinated carbons such as those described in co-pending U.S. pat. application Ser. No. 08/635,356 filed is Apr. 19, 1996, the disclosure of which is hereby incorporated by reference in its entirety.

The volume resistivity of the coated electrode is for example from about $10^{-1}$ to about $1^{-1}$ ohm-cm, and preferably from $10^{-5}$ to $10^{-1}$ ohm-cm. The surface roughness is less than about 5 microns and preferably from about 0.01 to about 1 micron.

In a preferred embodiment of the invention, the composite coating is coated over at least a portion of the nonattached regions of the electrode member. The nonattached region of the electrode member is the entire outer surface region of the electrode minus the region where the electrode is attached to the mounting means 54 and minus the anchoring area (55 in FIG. 4). It is preferred that the coating cover the portion of the electrode member which is adjacent to the donor roll. In another preferred embodiment of the invention, the composite coating is coated in an entire area of the electrode member located in a central portion of the electrode member and extending to an area adjacent to the nonattached portion of the electrode member. This area includes the entire surface of the electrode member minus the anchoring area (55 in FIG. 4). In an alternative embodiment, the entire length of the electrode member is coated with the composite coating, including the anchoring area 55 and mounting area 56. In embodiments, at least a portion refers to the nonattached region being coated, or from about 10 to about 90 percent of the electrode member.

Toner can accumulate anywhere along the electrode member, but it will not affect development unless it accumulates in the length of the electrode member near to the donor roll or on the length closest to the photoreceptor. Therefore, it is preferred that the composite coating cover the electrode member along the entire length corresponding to the donor roll, and on the entire length corresponding to the photoreceptor.

The composite coating may be deposited on at least a portion of the electrode member by any suitable known liquid or powder coating methods especially dip coating and electrostatic powder coating. In a preferred deposition method, the material coating is coated on the electrode member by dip coating. After coating, the composite coating is preferably air dried and cured at a temperature suitable for curing the specific composite material. Curing temperatures range from about 70 to about 300° C., and preferably from about 100 to about 250° C.

The average thickness of the coating is from about 1 to about 30 μm thick, and preferably from about 2 to about 10 μm thick. If the coating is applied to only a portion of the electrode member, the thickness of the coating may or may not taper off at points farthest from the midpoint of the electrode member. Therefore, the thickness of the coating may decrease at points farther away from the midpoint of the electrode.

The electrode members of the present invention, the embodiments of which have been described herein exhibit superior performance in terms wear resistance and decreased accumulation of toner on the surface of the electrode member, while also maintaining electrical properties which stimulate production of powder cloud development without charge build-up. In addition, the electrode members herein exhibit superior mechanical properties such as durability against donor roll surfaces which are normally made of tough materials such as ceramics.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Preparation of Wire to be Coated

A stainless steel wire of about 3 mil thickness is preferably cleaned to remove obvious contaminants.

A dip coating apparatus consisting of a 1 inch (diameter) by 15 inches (length) glass cylinder sealed at one end to hold the liquid composite coating material can be used for dip coating the wire. A cable attached to a Bodine Electric Company type NSH-12R motor can be used to raise and lower a wire support holder that keeps the wire taut during the coating process. The dip and withdraw rate of the wire holder into and out of the coating solution can be regulated by a motor control device from B&B Motors & Control Corporation, (NOVA PD DC motor speed control). After coating, a motor driven device can be used to twirl the wire around its axis while it receives external heating to allow for controlled solvent evaporation. When the coating is dry and/or non-flowable, the coated wire can be heated in a flow through oven using a time and temperature schedule to complete either drying or cure/post cure of the coating.

The general procedure may include: (A) cleaning and degreasing the wire with an appropriate solvent, for example, acetone, alcohol or water, and roughened if necessary by, for example, sand paper; (B) the coating material may be adjusted to the proper viscosity and solids content by adding solids or solvent to the solution; and (C) the wire is dipped into and withdrawn from the coating solution, dried and cured/post cured, if necessary, and dipped again, if required. The coating thickness and uniformity are a function of withdrawal rate and solution viscosity, (solids content in most solvent based systems) and a drying schedule consistent with the uniform solidification of the coating.

Preparation of Composite Coating Solutions:

Example 2

Coated Electrodes With Ceramer Composition

A ceramer composition was prepared as follows. A stock solution of VITON GF® was prepared by dissolving 250 grams of VITON GF® in 2.5 liters of methyl ethyl ketone (MEK) with stirring at room temperature (about 25° C.). A 4 liter plastic bottle and a moving base shaker were used to prepare the stock solution and the mixture was shaken for about 1 to 2 hours. The above solution was then transferred to a 4 liter Erlenmeyer flask and 25 ml of an amine silane dehydrofluorinating agent, 3-(N-strylmethyl-2-aminoethylaminopropyl) trimethoxysilane hydrochloride (S- 1590, available from Huls America Inc. in its hydrochloride form) was added. The contents of the flask were then stirred using a mechanical stirrer while maintaining the temperature between about 55 to about 60° C. After stirring for about 30 minutes, 12.5 grams of tetraethoxyorthosilicate (TEOS), available from Huls America Inc., was added and stirring continued for another 5 minutes. About 25 grams of acetic acid was then added. The stirring was continued while heating the contents of the flask at around 65° C. for another 4 hours. During this time the color of the solution turned light yellow. The above yellow solution can then be cooled to room temperature (about 25° C.) and can be used as electrode coatings in accordance with the procedure outlined in Example I

Example 3

Coated Electrodes with Grafted Ceramer Composition

A grafted ceramer composition was prepared by dissolving 250 grams of VITON GF® in 2.5 liters of methyl ethyl ketone (MEK) by stirring at room temperature (about 25°C.). This is accomplished by using a 4 liter plastic bottle and a moving base shaker. It takes approximately 1 to 2 hours to accomplish the dissolution depending upon the speed of the shaker. The above solution is then transferred to a 4 liter Erlenmeyer flask and 25 mil of an amine dehydrofluorinating agent, 3-(N-strylmethyl-2-aminoethylaminopropyl) trimethoxysilane hydrochloride (S-1590, available from Huls America Inc. in its hydrochloride form) was added. The contents of the flask were then stirred using a mechanical stirrer while maintaining the temperature between about 55° C. and about 60° C. After stirring for about 30 minutes, 50 grams of ethoxy terminated polysiloxane (PS-393) and 50 grams of tetraethoxyorthosilicate both available from Huls America Inc. were added and stirring continued for about another 10 minutes. About 25 grams of acetic acid was then added. The stirring was continued while heating the contents of the flask at 10 around 55° C. for another 4 hours. During this time the color of the solution turned light brown. This solution can then be cooled to room temperature and used for electrode coatings in accordance with the procedure outlined in Example I.

Example 4

Coated Electrodes With Volume Graft Composition

A volume graft was prepared by dissolving 2,500 grams of VITON GF® in 25 liters of methylethyl ketone (MEK) by stirring at room temperature (about 25° C.). This is accomplished by vigorous stirring using a mechanical stirrer. It takes approximately 2 to 4 hours to accomplish the dissolution depending upon the intensity of stirring. The stirring proceeds until a color change to clear. The above solution is then transferred to a reaction vessel and 250 ml of an amine dehydrofluorinating agent, 3-(N-strylmethyl-2-aminoethylaminopropyl) trimethoxysilane hydrochloride (S-1590, available from Huls of America, Inc. Piscataway, N.J. in its hydrochloride form) was added. The contents of the flask were then stirred using a mechanical stirrer while maintaining the temperature between about 55 and about 60°C. After stirring for about 30 minutes, 500 ml of 100 centistoke vinyl terminated polysiloxane (PS-441) also available from Huls of America, Inc. was added and stirring continued for about another 10 minutes. A solution of 100 grams of benzoyl peroxide in a 1000 ml. mixture of toluene and MEK (80:20) was then added. The stirring was continued while heating the contents of the flask to around 55° C. for another 2 hours. During this time the color of the solution turned light yellow. This solution can then be used for electrode coatings in accordance with the procedures outlined in Example I.

Example 5

Coated Electrodes With Titamer Composition

A titamer composition was prepared as follows. A stock solution of VITON GF® was prepared by dissolving 250 grams of VITON GF® in 2.5 liters of methylethyl ketone (MEK) with stirring at room temperature (about 25° C.) in a 4 liter plastic bottle with a moving base shaker for approximately 1 to about 2 hours. The above solution was then transferred to a 4 liter Erlenmeyer flask and 25 ml of amine dehydrofluorinating agent, 3-(N-strylmethyl-2-aminoethylaminopropyl) trimethoxysilane hydrochloride (S-1590, available from Huls America Inc. in its hydrochloride form) was added. The contents of the flask were then stirred using a mechanical stirrer while maintaining the temperature between about 55° C. and about 60° C. After stirring for 30 minutes, 12.5 grams of titanium isobutoxide, available is from Huls America Inc. (about 5% by weight based on the weight of VITON GF®), was added and stirring continued for another 5 minutes. About 25 grams of acetic acid was then added. The stirring was continued while heating the contents of the flask at around 65° C. for another 4 hours. During this time the color of the solution turned light yellow. The above yellow solution can then be cooled to room temperature (about 25° C.). This dispersion can then be dip coated onto an electrode wire in accordance with the procedure outlined in Example I.

Example 6

Coated Electrodes With Grafted Titamer Composition

A grafted titamer composition was prepared by dissolving 250 grams of VITON GF® in 2.5 liters of methylethyl ketone (MEK) by stirring at room temperature (about 25° C.) in a four liter plastic bottle using a moving base shaker. It takes approximately 1 to about 2 hours to accomplish the dissolution depending upon the speed of the shaker. The above solution was then transferred to a 4 liter Erlenmeyer flask and 25 mil of amine dehydrofluorinating agent, 3-(N-strylmethyl-2aminoethylaminopropyl) trimethoxysilane hydrochloride (S-1590, available from Huls America, Inc. in its hydrochloride form) was added. The contents of the flask were then stirred using a mechanical stirrer while maintaining the temperature to between about 55° C. and about 6° C. After stirring for 30 minutes, 50 grams of ethoxy terminated polysiloxane (PS-393) and 50 grams of titanium isobutoxide both available from Huls of America, Inc. were added and stirring continued for another 10 minutes. About 25 grams of acetic acid was then added. The stirring continued while heating the contents of the flask at around 55° C. for another 4 hours. During this time the color of the solution turned light brown and was allowed to cool to room temperature. This dispersion can then be dip coated onto an electrode wire in accordance with the procedure outlined in Example I.

Example 7

Coated Electrodes With Polyimide-polysiloxane Copolymer Composition

A polyimide-siloxane copolymer was prepared as follows. To a 1 liter round bottom flask equipped with a distillation apparatus was added 500 milliliters of Nmethylpyrrolidone. Thereafter, 50 grams of benzophenone dianhydride (obtained from Aldrich) was dissolved in the N-methylpyrrolidone in the flask. Subsequently, a mixture of 50 grams of methylene dianiline (obtained from Aldrich) and bis-gamma aminopropyl-tetramethyldisiloxane (obtained from Patrash Systems) in a ratio of 7:3 was added to the above solution. The contents of the flask were subsequently maintained at room temperature (about 25° C.) for about 24 hours. The resulting solution of the polyamic acid, which is a random copolymer, was heated to distill off the solvent. A fresh batch of 400 milliliters of the solvent was then added to the flask and the contents were then distilled to dryness under vacuum (10 mm Hg).

The process of adding a fresh batch of solvent and distilling to dryness under vacuum was repeated 2 more times, thereby azeotropically removing water, a reaction byproduct, from the reaction mixture. The light yellowish semisolid thus obtained was once again dissolved in 500 milliliters of N-methylpyrrolidone by stirring and warming to about 70° C. The resulting solution was then added dropwise to a stirring 2 liters of methanol in a 4 liter beaker. The methanol was vigorously stirred during the addition. Thereafter a solid precipitated and was collected by filtration and washed 3 times with 100 milliliter aliquots of methanol. Upon drying of the solid, the product was identified as a block copolymer of polyimide and siloxane by nuclear magnetic resonance spectra ($^{1}$H-nmr, $^{13}$C-nmr, and $^{29}$Si-nmr) and an infrared spectrum.

A solution of the polyimide-siloxane block copolymer thus obtained was prepared by dissolving 1 gram of the polymer in 100 milliliters of dichloromethane. This final solution can be applied to an electrode wire in accordance with the procedures outlined in Example I.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. An apparatus for developing a latent image recorded on a surface, comprising:

wire supports;

a donor member spaced from the surface and being adapted to transport toner to a region opposed from the surface;

an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a composite coating on at least a portion of nonattached regions of said electrode member.

2. An apparatus in accordance with claim 1, wherein said composite coating comprises a first monomer segment, a second monomer segment, and an optional third monomer segment, and wherein said composite is a substantially uniform, integral, interpenetrating network of said first monomer segment and said second monomer segment, and optionally said third monomer segment.

3. An apparatus in accordance with claim 2, wherein said first monomer segment is selected from the group consisting of a haloelastomer, polyimide, polyamide, polysulfone, polystyrene, polypropylene and polyester.

4. An apparatus in accordance with claim 3, wherein said haloelastomer is a fluoroelastomer.

5. An apparatus in accordance with claim 4, wherein said second monomer segment is a polyorganosiloxane.

6. An apparatus in accordance with claim 4, wherein said second monomer segment is selected from the group consisting metal alkoxides, metal halides, and metal hydroxides.

7. An apparatus in accordance with claim 6, wherein said second monomer segment is selected from the group consisting of titanium isobutoxide and tetraethoxyorthosilicate.

8. An apparatus in accordance with claim 7, wherein said third grafted segment is a polyorganosiloxane.

9. An apparatus in accordance with claim 3, wherein said first monomer segment is selected from the group consisting of polyester, polyimide and polyamide.

10. An apparatus in accordance with claim 9, wherein said second monomer segment is a polyorganosiloxane.

11. An apparatus in accordance with claims 5, 8 or 10, wherein said polyorganosiloxane has the following formula I:

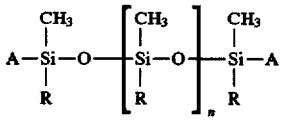

where R is selected from the group consisting of an alkyl from about 1 to about 24 carbons, an alkenyl of from about 2 to about 24 carbons, and a substituted or unsubstituted aryl of from about 4 to about 24 carbons; A is selected from the group consisting of an aryl of from about 6 to about 24 carbons, a substituted or unsubstituted alkene of from about 2 to about 8 carbons, and a substituted or unsubstituted alkyne of from about 2 to about 8 carbons; and n is a number of from about 2 to about 400.

12. An apparatus in accordance with claim 1, wherein said composite coating comprises a composite selected from the group consisting of a volume grafted haloelastomer, a titamer, a grafted titamer, a ceramer, a grafted ceramer, a polyimide polyorganosiloxane and a polyester polyorganosiloxane.

13. An apparatus in accordance with claim 12, wherein said ceramer has the following formula II:

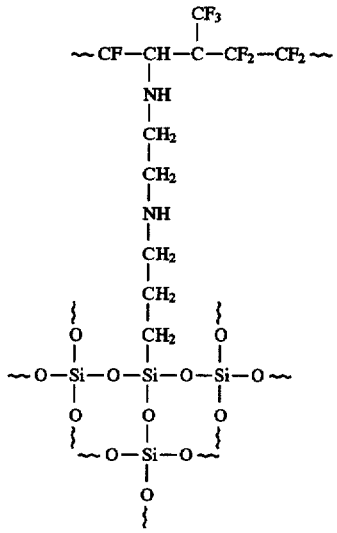

wherein the symbol "~" represents a continuation of the polymer network.

14. An apparatus in accordance with claim 12, wherein said grafted ceramer has the following formula III:

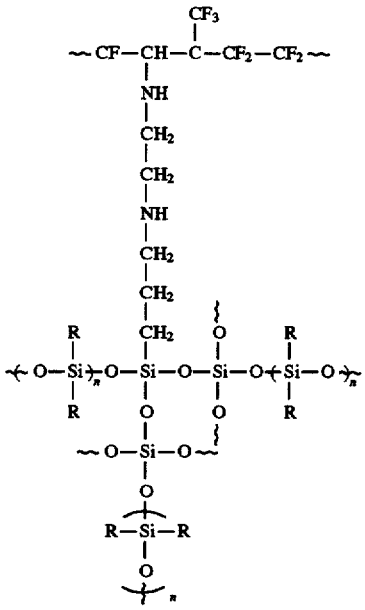

wherein R is selected from the group consisting of an alkyl from about 1 to about 24 carbons, an alkenyl of from about 2 to about 24 carbons, and a substituted or unsubstituted aryl of from about 4 to about 24 carbons; n is a number of from about 2 to about 400; and the symbol "~" represents a continuation of the polymer network.

15. An apparatus in accordance with claim 12, wherein said titamer has the following formula IV:

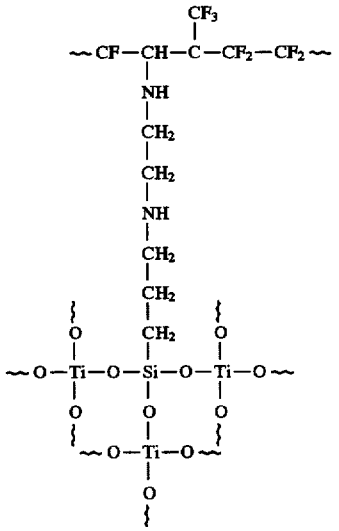

wherein the symbol "~" represents the continuation of the polymeric network.

16. An apparatus in accordance with claim 12, wherein said grafted titamer has the following formula V:

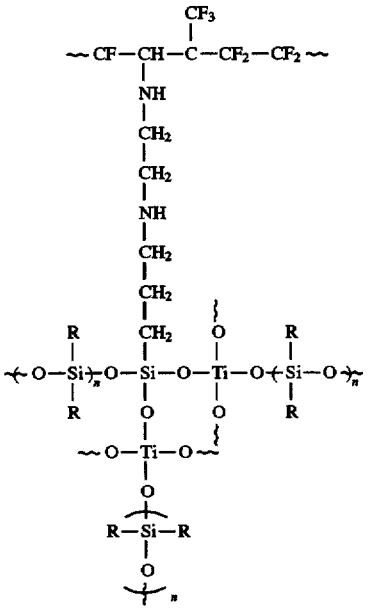

wherein R is selected from the group consisting of an alkyl from about 1 to about 24 carbons, an alkenyl of from about 2 to about 24 carbons, and a substituted or unsubstituted aryl of from about 4 to about 24 carbons; n is a number of from about 2 to about 400; and the symbol "~" represents a continuation of the polymer network.

17. An apparatus in accordance with claim 1, wherein said composite coating comprises an electrically conductive filler dispersed therein, wherein said electrically conductive filler is selected from the group consisting of carbon black, metal oxides, and metal hydroxides.

18. An apparatus in accordance with claim 1, wherein said composite coating is present on from about 10 to about 90 percent of said electrode member.

19. An apparatus in accordance with claim 2, wherein said second monomer has a low surface energy of from about 10 to about 25 dynes/cm.

20. An apparatus in accordance with claim 2, wherein said first monomer segment has a toughness of from about 2,000 to about 25,000 in-lb/in$^3$.

21. An electrophotographic process comprising:

a) forming an electrostatic latent image on a charge-retentive surface;

b) applying toner in the form of a toner cloud to said latent image to form a developed image on said charge retentive surface, wherein said toner is applied using a development apparatus comprising wire supports; a donor member spaced from the surface and being adapted to transport toner to a region opposed from the surface; an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image, wherein opposed end regions of said electrode member are attached to said wire supports adapted to support the opposed end regions of said electrode member; and a composite coating on at least a portion of nonattached regions of said electrode member;

c) transferring the toner image from said charge-retentive surface to a substrate; and d) fixing said toner image to said substrate.

* * * * *